United States Patent [19]

Price

[11] 4,124,206

[45] Nov. 7, 1978

[54] WATER JUMP ROPE DEVICE

[76] Inventor: Donald C. Price, 34539 Libke, Mount Clemens, Mich. 48043

[21] Appl. No.: 731,084

[22] Filed: Oct. 8, 1976

[51] Int. Cl.[2] ..... A63B 5/22

[52] U.S. Cl. ..... 272/74; 239/261; 239/280; 272/1 B

[58] Field of Search ..... 272/74, 75, 1 B; 239/279, 280, 261; 285/278, 275, 288, 280, 281, 179

[56] References Cited

U.S. PATENT DOCUMENTS

| | | | |
|---|---|---|---|
| D. 194,920 | 4/1963 | Darling | 272/1 B UX |
| 331,806 | 12/1885 | McGahan | 285/278 |
| 835,882 | 11/1906 | Eggers | 239/280 X |
| 911,717 | 2/1909 | Gibbs | 285/278 X |
| 1,634,261 | 7/1927 | Knaliff | 239/280 X |
| 1,866,844 | 7/1932 | De Vos | 239/261 X |
| 2,558,663 | 6/1951 | Olschewski | 239/261 |
| 2,580,626 | 1/1952 | Warren | 285/281 X |
| 3,326,551 | 6/1967 | Clarke | 272/74 |
| 3,481,600 | 12/1969 | Lang, Sr. et al. | 272/74 |

FOREIGN PATENT DOCUMENTS

| | | | |
|---|---|---|---|
| 1,504,797 | 10/1967 | France | 239/280 |
| 684,987 | 12/1939 | Fed. Rep. of Germany | 272/1 B |
| 8,468 of | 1900 | United Kingdom | 285/281 |

OTHER PUBLICATIONS

"Skip-A-Roo" The Evening Star, Washington, D. C. Apr. 27, 1965, pp. B-22.

*Primary Examiner*—Richard C. Pinkham
*Assistant Examiner*—Arnold W. Kramer
*Attorney, Agent, or Firm*—William L. Fisher

[57] ABSTRACT

Improvement in a water powered jump rope device having a pair of standards and a hollow water-conducting jump rope rotatably supported by and between the standards, the improvement comprising each standard being free standing and consisting of a hollow base and a water-conducting upright pipe supported on the base, the base having a threaded fill opening for receiving a ballast, the lower end of the upright pipe threadably engaged in the fill opening, the standard having a liquid inlet therefor, a water-conducting swivel joint carried on a side of the upright pipe near the upper end thereof, the swivel joint comprising a threaded boss formed in a side of the upright pipe, a threaded hollow gland threadably engaged in th boss, a second water-conducting pipe, the second pipe rotatably carried in the interior of the gland, a flange in the inner end of the second pipe, a radial surface on the inner end of the gland which serves as a bearing surface for the flange during rotation of the second pipe, the radial surface and the flange forming a water-tight rotating seal for the swivel joint during operation of the device, a water-conducting connecting member engaged on the outer end of the second pipe, the interior of the connecting member formed by intersecting apertures intersecting each other at an obtuse angle, and a third water-conducting pipe having its inner end engaged on the connecting member and its outer end frictionally connected to an end of the jump rope.

2 Claims, 6 Drawing Figures

WATER JUMP ROPE DEVICE

My invention relates to water jump rope devices of the type shown in U.S. Pat. No. 3,481,600 to G. H. Lang, Sr., et al., which, as far as known to applicant, has not been successfully marketed due to deficiencies therein which, inter alia, are its complexity and the instability of the upright supports thereof.

The principal object of my invention is to provide improvements in such devices which overcome the foregoing deficiencies and render my improved water jump rope device easy to manufacture and stable and efficient in operation.

The foregoing object of my invention and the advantages thereof will become apparent during the course of the following description, taken in conjunction with the accompanying drawings, in which.

Figure 1:
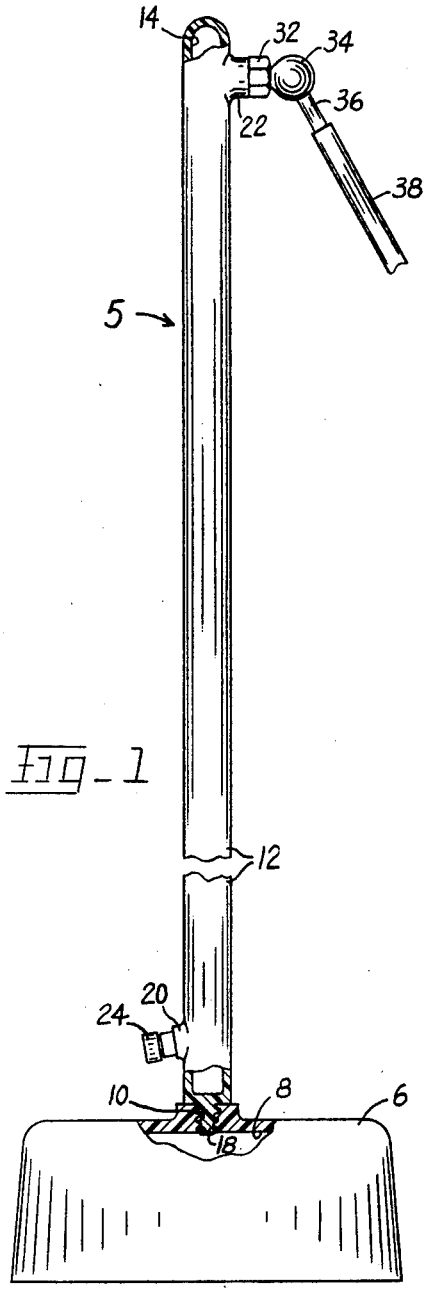
FIG. 1 is a front elevational view with parts in section of an improved water jump rope device embodying my invention.
Figure 2:
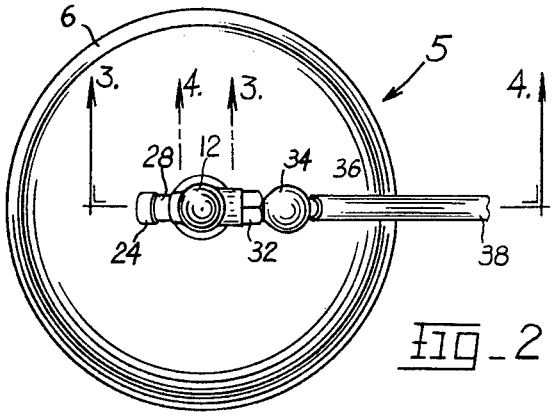
FIG. 2 is a top plan view of said device.
Figure 4:
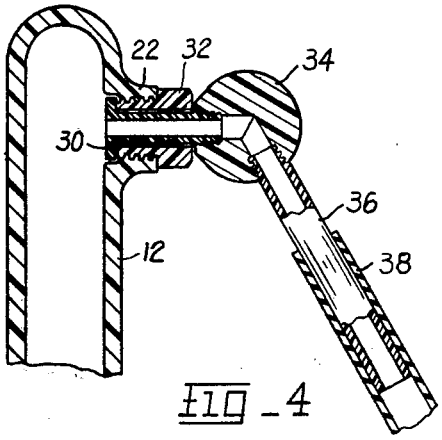
Figure 3:
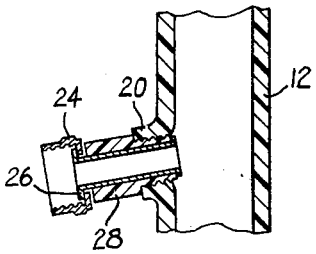
Figure 5:
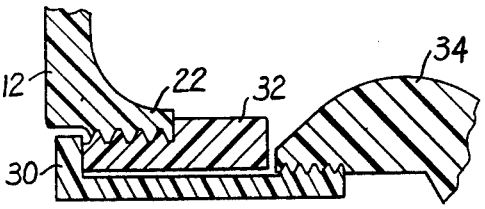

FIGS. 3 and 4 are respective sectional views of portions of the structure of FIG. 2 taken on the lines 3—3 and 4—4 thereof;

FIG. 5 is an enlarged view of part of the structure of FIG. 4; and

Figure 6:
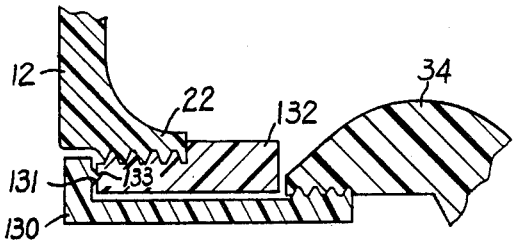

FIG. 6 is a view similar to FIG. 5 of a modified form of a swivel joint embodying my invention.

Referring to the drawings in greater detail and first to FIGS. 1-5, 5 generally designates said water jump rope device which comprises a pair of standards for rotatably supporting an apertured jump rope 38 therebetween. For convenience of illustration only one such standard is shown. Each said standard comprises a hollow base 6 and an upright pipe 12 supported on said base 6. Said base 6 is hollow and has a fill opening 10 in the center of its top wall into which a ballast such as water is poured so that the filled base acts as a ballast for said device 5 to make it stable during operation thereof. Said opening 10 is threaded and threadably engages an externally threaded solid boss formed on the lower end of said pipe 12 to stabalize and support said pipe 12 in its vertical position. The vertical pipe 12 has an angularly directed hollow threaded boss 20 near its lower end and a horizontally directed hollow threaded boss 22 near its upper end. The boss 22 is disposed on the opposite side of said pipe 12 from said boss 20. Said boss 20 threadably engages a threaded gland 28 which rotatably carries a hose fitting 24.

Said swivel joint consists of a ball 34, two pipes 30 and 36 and a hollow externally threaded gland 32. The latter is threadably engaged in said boss 22. Said gland 32 rotatably carries said pipe 30 which has a flange on its inner end for holding itself secured to said gland 32. Said flange and the inner end of said gland 32 have radial faces which make full face engagement with each other to form a liquid-tight rotating seal therebetween as best shown in FIG. 5. The outer end of said pipe 30 extends beyond the outer end of said gland 32 and is threaded to threadably engage one of two intersecting threaded apertures formed in said ball 34. Said intersecting apertures are formed at an obtuse angle to each other. The other aperture in said ball 34 threadably engages the inner end of said pipe 36, the outer end of which engages said jump rope 38. Said pipe 36 extends out of said ball 34 at an angle to said pipe 30 so that when said swivel joint is rotated the outer end thereof describes a circle and, together with the opposite swivel joint, confines the movement of said jump rope 38 to a circle.

In assembly of said device 5, said base 6 is filled with a ballast through said fill opening 10 and said boss 18 is threaded into said opening 10. The gland 28 is threaded in the boss 20. The gland 32 is first disposed on said pipe 30 and the outer end of the latter is threaded into one aperture of said ball and thereafter said gland 32 is threaded into said boss 22. The inner end of said pipe 36 is then threaded into the other aperture of said ball 34 and an end of said jump rope 38 is fastened onto the outer end of said pipe 36. A water hose from a suitable source of water under pressure is connected to said hose fitting 24. For better liquid flow from the interior of said pipe 12 to the jump rope 38 no part of the swivel joint extends into the hollow of said upright pipe 12. The standard (not shown) is similar to that shown and described except that the swivel joint therefor is made non-water conducting by plugging the pipe 36 or by employing a solid rod in lieu thereof.

Referring now to FIG. 6 a modified form of a swivel joint is shown therein which reduces the friction between the radial faces thereof. Said modified swivel joint comprises a gland 132 having an annular groove 133 formed on its radial face. The rotating pipe 130 which threadably engages the connecting member 34 has an annular protuberance 131 formed on a radial face thereof. The protuberance 131 operates in the groove 133 and forms a watertight rotating seal therewith.

It will thus be seen that there has been provided by my invention improvements in a water jump rope device in which the object hereinabove set forth, together with many thoroughly practical advantages, has been successfully achieved. While a preferred embodiment of my invention has been shown and described, it is to be understood that variations and changes may be resorted to without departing from the spirit of my invention as defined by the appended claims.

What I claim is:

1. Improvement in a water powered jump rope device having a pair of standards and a hollow water-conducting jump rope rotatably supported by and between said standards, said improvement comprising each said standard being free standing and consisting of a hollow base and a water-conducting upright pipe supported on said base, said base having a threaded fill opening for receiving a ballast, the lower end of said upright pipe threadably engaged in said fill opening, said standard having liquid inlet means therefor, a water-conducting swivel joint carried on a side of said upright pipe near the upper end thereof, said swivel joint comprising a threaded boss formed in a side of said upright pipe, a threaded hollow gland threadably engaged in said boss, a second water-conducting pipe, said second pipe rotatably carried in the interior of said gland, a flange on the inner end of said second pipe, a radial surface on the inner end of said gland which serves as a bearing surface for said flange during rotation of said second pipe, said radial surface and said flange forming a water-tight rotating seal for said swivel joint during operation of said device, a water-conducting connecting member engaged on the outer end of said second pipe, the interior of said connecting member formed by intersecting apertures intersecting each other at an obtuse angle, and a third water-conducting pipe having its inner end engaged on said connecting member and its outer end frictionally connected to an end of said jump rope.

2. Improvement as claimed in claim 1, an annular protuberance and an annular groove formed in and between said radial face and said flange, said protuberance rotatably operative in said groove to aid in water-sealing said swivel joint.

* * * * *